US009277315B2

(12) United States Patent
Ranganathan et al.

(10) Patent No.: US 9,277,315 B2
(45) Date of Patent: Mar. 1, 2016

(54) POP-UP NOISE SUPPRESSION IN AUDIO

(71) Applicants: ST-ERICSSON INDIA PVT. LTD., New Delhi (IN); ST-ERICSSON SA, Plan-les-Ouates (CH)

(72) Inventors: Sanjeev Ranganathan, Bangalore (IN); Shyam Somayajula, Bangalore (IN); Srinath Sridharan, Bangalore (IN); Lionel Cimaz, Pleumeleuc (FR)

(73) Assignee: ST-Ericsson SA, Plan-les-Oates (CH)

( * ) Notice: Subject to any disclaimer, the term of this patent is extended or adjusted under 35 U.S.C. 154(b) by 133 days.

(21) Appl. No.: 14/301,115

(22) Filed: Jun. 10, 2014

(65) Prior Publication Data

US 2014/0334632 A1 Nov. 13, 2014

Related U.S. Application Data

(62) Division of application No. 12/713,078, filed on Feb. 25, 2010, now Pat. No. 8,787,597.

(30) Foreign Application Priority Data

Feb. 27, 2009 (EP) ..... 09305183

(51) Int. Cl.
*H04R 3/00* (2006.01)
*G10K 11/00* (2006.01)

(52) U.S. Cl.
CPC ..... *H04R 3/002* (2013.01); *G10K 11/002* (2013.01); *H04R 3/00* (2013.01); *H04R 3/007* (2013.01)

(58) Field of Classification Search
CPC ..... H04R 3/002; G10K 11/002
See application file for complete search history.

(56) References Cited

U.S. PATENT DOCUMENTS 6,774,684 B2 * 8/2004 Wu ..... H03F 3/181 327/131
7,164,312 B1 * 1/2007 Singh ..... H03F 1/305 330/9
7,602,237 B2 * 10/2009 Shimizu ..... H03F 1/305 330/51

* cited by examiner

*Primary Examiner* — Sonia Gay
(74) *Attorney, Agent, or Firm* — Howlson & Arnott

(57) ABSTRACT

Systems and methods for suppressing pop-up noise in an audio signal are disclosed. The system includes a driver circuit shared by a pin interface and a complementary pin interface. A control unit is coupled to the pin interface and the complementary pin interface. To activate the pin interface, the control unit is configured to first activate the driver output at the complementary pin interface. Once the complementary pin interface achieves a preset voltage, the driver output is switched to the pin interface by the control unit. In addition, the driver circuit can be calibrated for a DC offset on the complementary pin interface by re-using calibration data calculated at the pin interface. Further, DC correction signals can be provided from a pre-biasing circuit based on the calibration data of the driver circuit.

12 Claims, 3 Drawing Sheets

POP-UP NOISE SUPPRESSION IN AUDIO

CROSS-REFERENCE TO RELATED APPLICATIONS

This application is a divisional of U.S. patent application Ser. No. 12/713,078, filed Feb. 25, 2010, entitled POP-UP NOISE SUPPRESSION IN AUDIO, which claims priority to and/or benefit of European Application No. EP 09305183.7, filed Feb. 27, 2009, entitled POP-UP NOISE SUPPRESSION IN AUDIO, the specifications of which are incorporated by reference herein in their entirety.

TECHNICAL FIELD

The disclosed subject matter relates to a system for reducing an audible pop-up noise produced when a speaker is powered up.

DESCRIPTION OF RELATED ART

Generally, a mobile phone has different types of speakers, such as a high power speaker, earphone speakers and a handset speaker, in order to provide enhanced audio experiences to a user. These speakers are coupled through a pin interface to an integrated circuit included in the mobile phone. The integrated circuit incorporates a number of driver circuits, which are powered-up to drive these speakers during operation of the mobile phone.

In certain conditions, such as when connecting a headset with the mobile phone, an audible pop-up noise emanates from the speakers before an expected audio signal is received. The pop-up noise is produced due to mismatches between the driver circuits. These mismatches may be caused due to various factors such as a difference in transient responses of the driver circuits and an error (offset) between settled output values of the driver circuits coupled across a particular speaker.

Ideally, the driver circuits coupled to a differentially driven speaker should have the same transient response so as to provide a symmetrical settled voltage across the speaker. But, generally, there exists a difference in the transient responses of the driver circuits due to differences in rate of charging of the driver circuits. Such differences in charging rates cause a large differential voltage to form at the output of the driver circuits, and in turn across a differentially coupled speaker. This differential voltage activates the coupled speaker and results in a pop-up noise from the speaker.

Further, when an input signal is applied to the driver circuit, either as a normal signal or as a differential signal, a DC offset is observed at the pin interface. The DC offset can be suppressed by calibrating the driver circuit using a variety of techniques, for example, by using successive approximation registers. However, these calibration techniques employ a large number of measurements of the output signal at the pin interface where the calibration is to be applied. As a result, the calibration time of each of the driver circuits is very high.

Additionally, in case the input signal is applied to the driver circuits across different speakers, for example, to provide stereo playback, the DC offset appearing at the output of only one driver circuit can be corrected since the signal pathway is mono. As a result, the DC offset across the driver circuit of the other speaker causes an audible pop-up noise. Such an audible pop-up noise results in a substandard interface between the mobile phone and a user and therefore, degrades the perceived quality of operation of the mobile phone.

BRIEF SUMMARY

This summary is provided to introduce concepts related to pop-up noise suppression in an audio output, which is further described below in the detailed description. This summary is not intended to identify essential features of the claimed subject matter, nor is it intended for use in determining the scope of the claimed subject matter.

In an implementation, a system for suppressing pop-up noise produced by devices, such as speakers, includes driver circuits implemented in a shared driver configuration to provide output signals to multiple pin interfaces. In the shared driver configuration, a single driver circuit can be shared between two or more pin interfaces. The system also includes a calibration unit to calibrate the driver circuits for an underlying DC offset.

Further, to suppress pop-up noise due to transient mismatches, a first pin interface coupled to a shared driver circuit is activated based on activation of a complementary pin interface in the shared driver circuit. Upon activation of the complementary pin interface, when an output voltage provided by the shared driver circuit at the complementary pin interface reaches a predefined voltage level, the output voltage is switched over to the first pin interface.

Furthermore, in case of stereo playback using a mono signal pathway, a pre-biasing circuit can be used to provide correction signals to multiple driver circuits. For example, when two driver circuits are used, the correction signals are based on the difference between the expected output signals and the received output signals at pin interfaces coupled to the two driver circuits. In an implementation, the pre-biasing circuit first provides a correction signal to one driver circuit, which is then powered up. The correction signal is then ramped for the second driver circuit. The pre-biasing circuit then provides the ramped correction signal to the second driver circuit, which is then powered up. The values of the correction signal and the ramped correction signal can be determined from the calibration data.

BRIEF DESCRIPTION OF THE DRAWINGS

The detailed description is provided with reference to the accompanying figures. In the figures, the left-most digit(s) of a reference number identifies the figure in which the reference number first appears. The same numbers are used throughout the drawings to reference like features and components.

DETAILED DESCRIPTION

Figure 1:
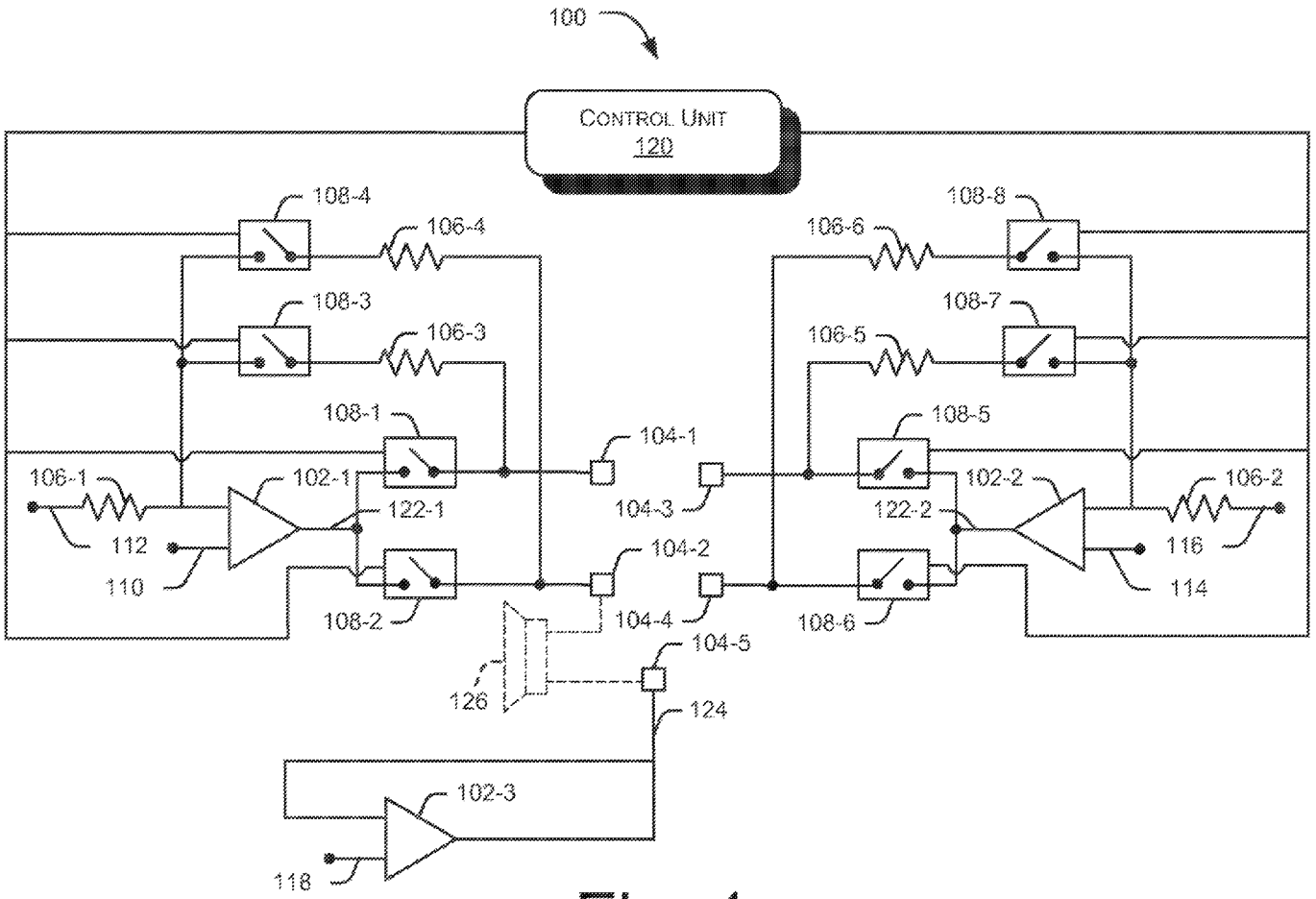
FIG. 1 illustrates a schematic diagram of an exemplary system to reduce transient response mismatch of a driver circuit.

The disclosed subject matter relates to a system for reducing an audible pop-up noise produced when a speaker is powered up. This system can be implemented in a variety of electronic or communication devices such as mobile phones, personal digital assistants (PDAs), music players, and so on. Such a system can be used to reduce calibration time of driver circuits across a speaker and to reduce transient mismatches produced in the driver circuits. The system therefore substantially improves a user interface of a device. The system further enhances the perceived quality of the device.

In an implementation, a system for suppressing pop-up noise produced by devices, such as speakers, includes driver circuits implemented in a shared driver configuration to provide output signals to multiple pin interfaces. In the shared driver configuration, a single driver circuit can be shared between two or more pin interfaces. Further, the system includes a calibration unit to calibrate a particular driver circuit for an underlying DC offset. The calibration unit calibrates the driver circuit at a pin interface using calibration techniques known in the art and acquires the corresponding calibration data. This calibration data is then re-used by the calibration unit to calibrate the driver circuit at complementary pin interfaces coupled to the same driver circuit. Therefore, the re-use of the calibration data provides for a reduction in the calibration time and allows for calibration of the driver circuits in real time at the user end.

Further, a difference in transient responses of the driver circuits can cause aberrations in the received output signal, which can lead to a pop-up noise at a speaker coupled to the pin interfaces of the driver circuits. To avoid this popup noise, a pin interface, coupled to a first driver circuit, is activated based upon activation of a complementary pin interface coupled to the first driver circuit in the shared driver configuration. When an output voltage provided by the first driver circuit at the complementary pin interface reaches a preset voltage level, the output voltage is switched over to the first pin interface. For this, the complementary pin interface is deactivated and the pin interface to be operated is activated.

Furthermore, in case of stereo playback, two driver circuits are simultaneously fed with input signals, which can be applied to the driver circuits through a mono signal pathway. The output signals of the driver circuits can have different DC offsets. In order to adjust the output signals and remove underlying DC offsets, a pre-biasing circuit can be used to provide correction signals at the pin interfaces of the driver circuits. The correction signals are based on the difference between expected output signals and the received output signals at the pin interfaces coupled to the driver circuits. This difference can be obtained from the calibration data gathered by the calibration unit.

In an implementation, the pre-biasing circuit first provides a correction signal to one driver circuit, which is then powered up. The correction signal is then ramped for the second driver circuit. The pre-biasing circuit then provides the ramped correction signal to the second driver circuit, which is then powered up. Thus the DC offsets at both the driver circuits can be corrected without resulting in any pop-up noise.

Exemplary Systems

FIG. 1 illustrates a schematic diagram of an exemplary system 100 to reduce transient response mismatch of a driver circuit. In an embodiment, the system 100 includes driver circuits 102-1, 102-2, and 102-3, collectively referred to as driver circuits 102, coupled to pin interfaces 104-1,104-2, 104-3,104-4, and 104-5, collectively referred to as pin interfaces 104. The pin interfaces 104 can be coupled to various devices such as a speaker, a headset, and so on. The system 100 further includes resistors 106-1, 106-2, 106-3, 106-4, 106-5, and 106-6, collectively referred to as resistors 106, and switches 108-1, 108-2, 108-3, 108-4, 108-5, 108-6, 108-7, and 108-8, collectively referred to as switches 108.

In said embodiment, the driver circuit 102-1 can be fed with an input signal 112 through the resistor 106-1 and a first reference signal 110, while the driver circuit 102-2 can be supplied with an input signal 116 through the resistor 106-2 and a second reference signal 114. Similarly, the driver circuit 102-3 can be provided with a third reference signal 118. In an implementation, the first reference signal 110, the second reference signal 114, and the third reference signal 118 can be common mode signals. The switches 108 can be coupled to a control unit 120, which may also be coupled to the pin interfaces 104.

In said embodiment, the driver circuit 102-1 can be implemented in a shared driver configuration to drive the pin interfaces 104-1 and 104-2. Accordingly, the driver circuit 102-1 provides an output signal 122-1 shared between the pin interfaces 104-1 and 104-2 through the switches 108-1 and 108-2, respectively. The output signal 122-1 through the switch 108-1 can be fed back to the input signal 112 through a first feedback loop, which includes the resistor 106-3 and the switch 108-3. Similarly, the output signal 122-1 through the switch 108-2 can also be applied to the input signal 112 through a second feedback loop, which includes the resistor 106-4 and the switch 108-4. The switches 108-1 and 108-3 20 activate the pin interface 104-1, when closed. In a similar manner, the switches 108-2 and 108-4 activate the pin interface 104-2, when closed. The closing and opening of the switches 108 can be controlled by the control unit 120, which in turn, controls the activation of the desired pin interfaces 104.

As can be seen from FIG. 1, the driver circuit 102-2 can also be 25 implemented in a shared driver configuration to provide a shared output signal 122-2 to drive the pin interfaces 104-3 and 104-4. On the other hand, the driver circuit 102-3 provides an output signal 124 at the pin interface 104-5. It will be understood by a person skilled in the art that the number of driver circuits 102 in the system 100 can vary depending on the number of devices to be driven.

In an implementation, a device, for example, a speaker 126 can be coupled to the pin interfaces 104-2 and 104-5 and can be driven by the driver circuits 102-1 and 102-3. For this, the driver circuit 102-1 can be activated by applying the first reference signal 110 and the input signal 112, while the driver circuit 102-3 can be activated by applying the third reference signal 118.

Generally, the activation of the driver circuits 102-1 and 102-3 involves charging or discharging of components present within the internal circuitry of the driver circuits 102. Due to the differences in charging or discharging rates of the components, and in turn of the driver circuits 102, the driver circuits 102 provide differing output signals 122-1 and 124. The differing output signals 122-1 and 124 vary in their amplitude (magnitude) of voltage level at the pin interfaces 104-2 and 104-5 respectively during settling time of the driver circuits 102-1 and 102-3.

The settling time can be defined as the time elapsed between an application of an instantaneous input signal, such as the input signal 112, and the time at which the driver circuit, such as the driver circuit 102-1, provides an output signal, for example, the output signal 122-1, within a specified error band centered around the final steady value of the output signal. It is to be noted that even though spread of the electric potential energy provided by the differing output signals 122-1 and 124 across the pin interfaces 104-2 and 104-5 is for a short time, the amplitude of a resulting error signal can be large. The resulting error signal is a differential of the differing output signals 122-1 and 124. In simple words, the driver circuits 102-1 and 102-3 can have different transient responses with respect to each other. The transient response of a system can be defined as an electrical response of the system to a change, such as application of an input signal, from an equilibrium condition.

The error signal can result in an unwanted differential voltage to appear across the pin interfaces 104-2 and 104-5 before the respective driver circuits 102-1 and 102-3 are fully charged to provide symmetrical output signals 122-1 and 124. The symmetrical output signals 122-1 and 124 have the same amplitude or voltage level. In other words, the magnitude of potential energy provided by the symmetrical output signals 122-1 and 124 at the respective pin interfaces 104-2 and 104-5 is the same. Further, the differential voltage is capable of stimulating the device (not shown in the figure) coupled to the pin interfaces 104-2 and 104-5 to operate unreliably. For example, in case the device is a speaker, such differential voltage can provide an unwanted audible pop-up noise before the expected output is received from the speaker. Therefore, suppression of such unreliable behavior, for example, an audible pop-up noise, is desired for smooth operation.

In an implementation, in order to reliably drive the coupled device, driver circuits can be activated to drive complementary pin interfaces prior to activation of the pin interfaces to be operated so that the corresponding driver circuit can be charged to a desired level. In one case, the driver circuit 102-1 can drive the complementary pin interface 104-1 to attain a threshold or preset voltage prior to activation of the pin interface 104-2.

For this, the control unit 120 closes the switches 108-1 and 108-3 and opens up the switches 108-2 and 108-4. The control unit 120 monitors the voltage level being built up at the pin interfaces 104-1 and 104-5, during which the driver circuits 102-1 and 102-3 can be charged up to the desired level. Once the pin interfaces 104-1 and 104-5 achieve a threshold voltage, the control unit 120 opens up the switches 108-1 and 108-3 and closes the switches 108-2 and 108-4 to switch the output signal 122-1 of the driver circuit 102-1 over to the pin interface 104-2. Accordingly, the complementary pin interface 104-1 is deactivated and the pin interface 104-2 is activated to receive the output signal 122-1 from the charged up driver circuit 102-1. Therefore, the output signal 122-1 is symmetrical to the output signal 124 received at the pin interface 104-5.

The output signals 122-1 and 124, when symmetrical in nature, ensure a significant reduction in the amplitude of the error signal received across the pin interfaces 104-2 and 104-5, thereby reducing the unwanted differential voltage appearing across the pin interfaces 104-2 and 104-5. When the device coupled to the pin interfaces 104-2 and 104-5 is a speaker, this reduction in the unwanted differential voltage reduces the audible pop-up noise through the speaker. Therefore, the transient responses of the driver circuits 102-1 and 102-3 are improved by charging the driver circuits 102-1 and 102-3 for a longer duration through prior activation of the complementary pin interfaces, such as the pin interface 104-1.

In another case, when the pin interfaces 104-4 and 104-5 are to be 10 operated, a complementary pin interface 104-3 and the pin interface 104-5 can be activated to achieve a threshold voltage by activating the driver circuits 102-2 and 102-3 respectively. Subsequently, an output of the driver circuit 102-2 can be switched over to the required pin interface 104-4 by activating the required pin interface 104-4 and deactivating the complementary pin interface 104-3. For the purpose, the switches 108-5, 108-6, 108-7, and 108-8 can be controlled by the control unit 120 in a manner as explained for the driver circuit 102-1. Accordingly, the driver circuits 102-2 and 102-3 can be charged to a required level to provide symmetrical output signals 122-2 and 124 at the pin interfaces 104-4 and 104-5 respectively.

Similarly, when the pin interfaces 104-2 and 104-3 are to be operated, the complimentary pin interfaces 104-1 and 104-1 may be first activated. After stabilization of the driver circuits 102-1 and 102-2, the output may be shifted to the pin interfaces 104-2 and 104-3. This can be controlled by the control unit 120 through the switches 108, in a manner similar to that explained above.

Figure 2:
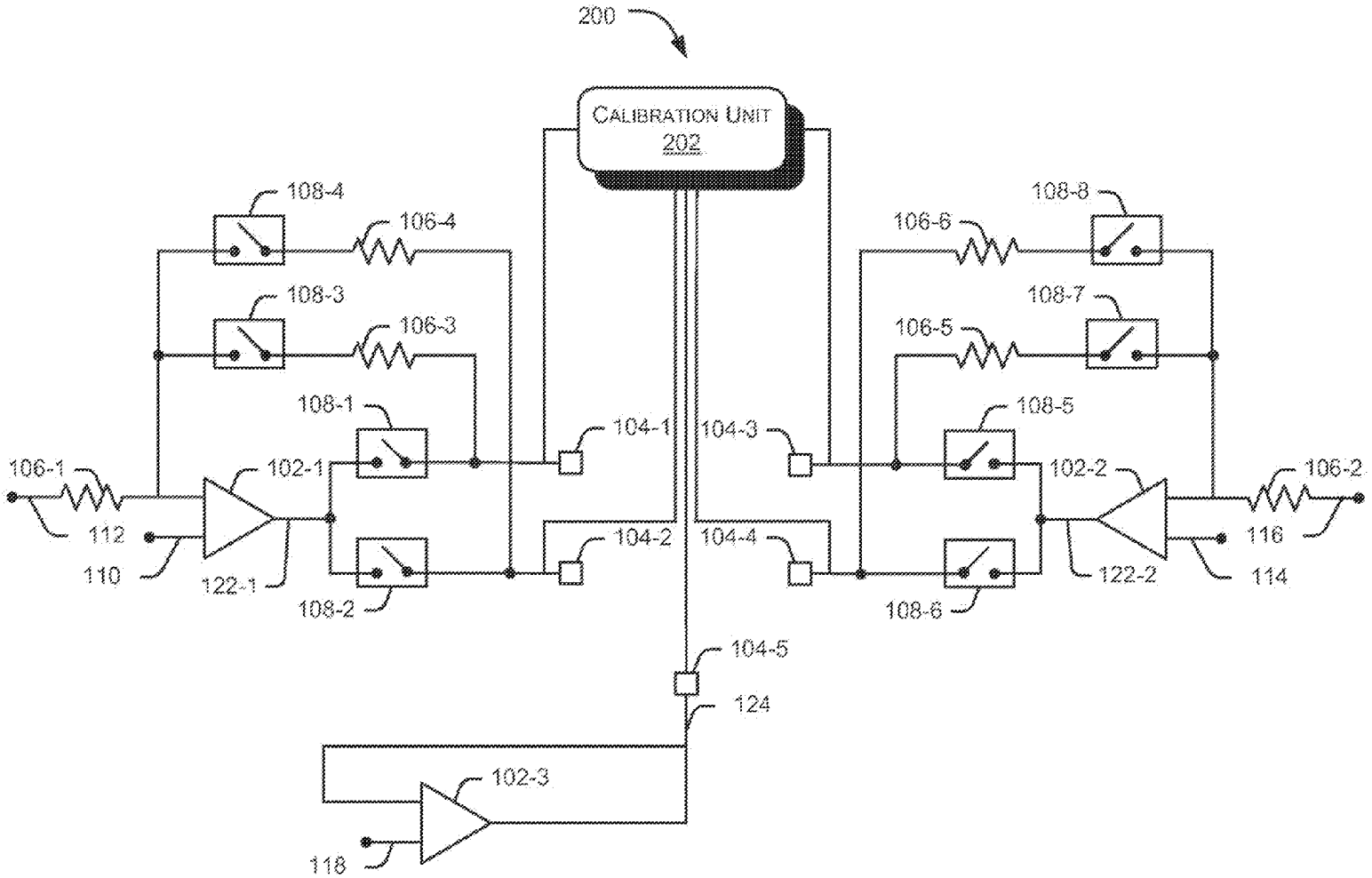
FIG. 2 illustrates a schematic diagram of an exemplary system configured to calibrate driver circuits for DC offset in real time.

FIG. 2 illustrates a schematic diagram of an exemplary system 200 configured to calibrate driver circuits 102, for DC offset, in real time. In an embodiment, the system 200 includes the driver circuits 102, the pin interfaces 104, the resistors 106, and the switches 108. The driver circuits 102 are coupled to the pin interfaces 104, in a shared driver configuration, through the resistors 106-3, 106-4, 106-5, and 106-6, and the switches 108 as explained in the description of FIG. 1.

In the present embodiment, the driver circuit 102-1 can provide an output signal 122-1 to the pin interfaces 104-1 and 104-2, while the driver circuit 5 102-2 can provide an output signal 122-2 to the pin interfaces 104-3 and 104-4. Further, the pin interfaces 104 can be coupled to a calibration unit 202, which facilitates calibration of the driver circuits 102-1 and 102-2 at the respective pin interfaces 104-1, 104-2, 104-3, and 104-4.

Ideally, the driver circuits 102, when activated, should provide 10 symmetrical output signals at the pin interfaces 104 coupled to a device, for example a speaker, to provide same voltages at the pin interfaces 104. However, it may be observed that the voltage levels differ at the pin interfaces 104 across the device even when the output signals applied at these pin interfaces 104 are symmetrical in nature. This deviation from an expected parameter, for example, voltage level, at the pin interfaces 104 after the settling time of the driver circuits 102 may be caused due to an offset. The offset may occur due to various factors such as mismatches between the driver circuits 102, and their temperature gradients.

When the offset is constant for a circuit topology, for example, a shared driver configuration, and does not change with time, the offset can be termed as DC offset. In an implementation, the DC offset can be contributed by signal pathways, which refer to conducting paths used by the input signals 112, 116, and 118 and the corresponding output signals 122-1, 122-2, and 124 at the respective pin interfaces 104. The DC offset can cause a change in amplitude of the output signals 122-1, 122-2, and 124, resulting in differing output signals being applied at the pin interfaces 104. In one case, when the device coupled to the pin interfaces 104 is a speaker, the differing output signals can lead to generation of an unwanted pop up noise from the speaker when the driver circuits 102 are powered up.

In order to correct for the DC offset, the driver circuits 102 are generally calibrated at the pin interfaces 104. The calibration of the driver circuits 102 refers to determination and, at times, correction of the DC offset at the corresponding pin interfaces 104. Typically, the DC offset is determined by observing a particular parameter, such as a voltage level, at the pin interfaces 104 when the input signals, such as input signals 112, 116, and 118, are not applied to the driver circuits 102. In this case, the received voltage level corresponds to the DC offset at the pin interfaces 104. Based on the voltage level at the pin interfaces 104, the required correction signals can be applied. Generally, the driver circuits 102 are calibrated under different circuit conditions in order to ensure reliable calibration.

In a first condition, the driver circuits 102 can be calibrated in no load condition to avoid any drop or flicker in the voltage level corresponding to the DC offset due to impedance of the device coupled at the pin interfaces 104. The no load condition corresponds to a condition when the devices coupled to the pin interfaces 104 are switched off and do not draw any current. In an implementation, a speaker coupled to the pin interface 104-1 can be switched off so that the speaker does not draw any current at the corresponding pin interfaces 104-1 or 104-2. Such switching off of the speaker operably disconnects the speaker from the corresponding pin interfaces 104 during calibration of the driver circuits 102-1 and ensures reliable calibration.

In a second condition, with respect to the driver circuit, for example, driver circuit 102-1, complementary driver circuits, such as driver circuit 102-2 and 102-3, are subjected to a high impedance state by opening the switches 108-5, 108-6, 108-7, 108-8, and 108-9 during calibration of a particular driver circuit, such as the driver circuit 102-1. This is performed to avoid reception of a differential signal at the pin interfaces 104-3 and 104-4 due to differing output signals provided by the driver circuits 102-2 during calibration of the driver circuit 102-1.

The two circuit conditions may be applied simultaneously during calibration of the DC offset. Generally, such a calibration is performed using a variety of techniques such as by using successive approximation registers (SAR), radix-based calibration, and so on. Typically, these techniques require a number of separate measurements at each pin interface for calibration of the pin interfaces 104 which consumes a lot of time. Therefore, the driver circuits 102 cannot be calibrated in real time.

In an implementation, as per the disclosed subject matter, the driver circuit 102-1 can be calibrated at the pin interface 104-1 by the calibration unit 202 10 using calibration techniques known in the art under the first and the second conditions, which are explained above. Accordingly, the calibration unit 202 calculates and records calibration data based on calibration of the driver circuit 102-1 at the pin interface 104-1. The calibration data includes measurements of gain of the signal pathway and DC offset at the pin interface 104-1. Since the driver circuit 102-1 is coupled to the pin interfaces 104-1 and 104-2 in a shared driver configuration, the calibration of the driver circuit 102-1 at the pin interface 104-2 can be expedited for real-time calibration by leveraging the linearity of the signal pathways. For this, the calibration data, which is calculated from the calibration of the driver circuit 102-1 at the pin interface 104-1, can be used by the calibration unit 202 to calibrate the driver circuit 102-1 at the pin interface 104-2.

Usually, a number of measurements of the gain and the DC offset are taken at the pin interface 104-2 for calibration. However, since the signal pathways coupled to the pin interfaces 104-1 and 104-2 are comparatively same due to the shared driver configuration, any difference in measured value and expected value of a specific parameter, for example, voltage level, at the pin interface 104-2 can be set to zero based on the calibration data gathered for the pin interface 104-1. As such, there is no need to calibrate the gain and the offset of the signal pathways coupled to the pin interfaces 104-1 and 104-2 separately. Therefore, in order to measure the offset at the pin interface 104-2, the calibration unit 202 reuses the calibration data obtained for the pin interface 104-1 to calibrate the driver circuit 102-1 at the pin interface 104-2.

The re-use of the calibration data allows for a significant reduction in the number of measurements required to estimate the gain and the offset at the pin interface 104-2. As a result, the driver circuit 102-1 can be dynamically calibrated during real-time at the user end, for example, when a system, such as a mobile phone, a laptop, and so on, that includes the driver circuit 102-1 is powered up. In another scenario, the driver circuit 102-1 can be calibrated at the pin interface 104-1 by re-using calibration data calculated during calibration of the driver circuit 102-1 at the pin interface 104-2, in a similar fashion.

Similarly, the driver circuit 102-2 can also be calibrated at the pin interfaces 104-3 and 104-4 as explained above for the calibration of the driver circuit 102-1.

Figure 3:
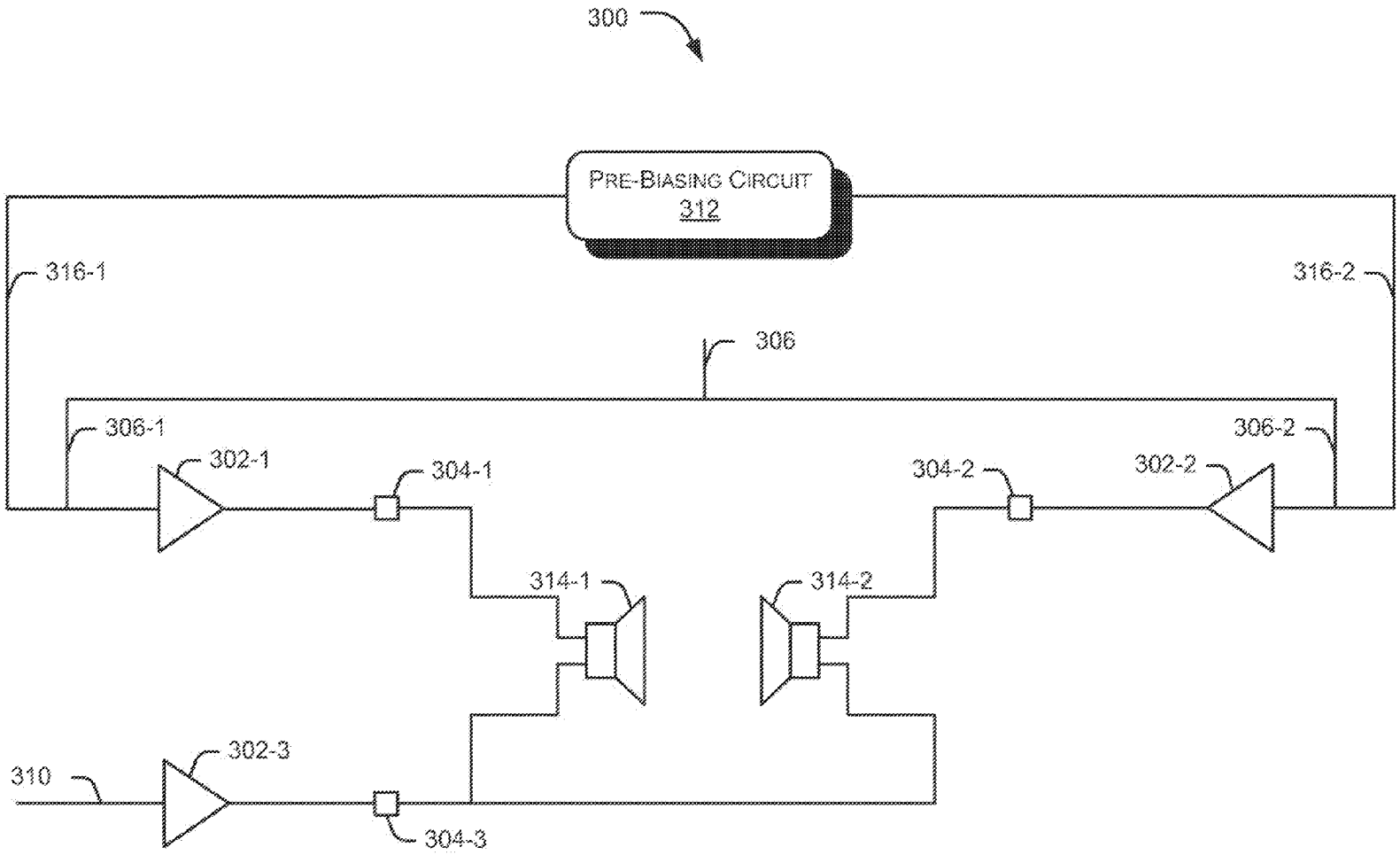
FIG. 3 illustrates a schematic diagram of an exemplary system for suppressing pop-up noise in audio to facilitate stereo playback of speakers.

FIG. 3 illustrates a schematic diagram of an exemplary system 300 15 for suppressing pop-up noise in audio to facilitate stereo playback of speakers. In an embodiment, the system 300 includes driver circuits 302-1, 302-2, and 302-3, collectively referred to as driver circuits 302. The driver circuits 302 are coupled to respective pin interfaces 304-1, 304-2, and 304-3, collectively referred to as pin interfaces 304. The driver circuits 302-1 and 302-2 can be supplied with input signals 306-1 and 306-2, collectively referred to as input signals 306, in a plurality of ways. In an implementation, the input signal 306 can be separated into two input signals IN-R 306-1 and IN-L 306-2 using methods known in the art. In an implementation, the signals IN-R 306-1 and IN-L 306-2 may be differential signals.

Thus, the IN-R 306-1 can be applied to the driver circuit 302-1 and 25 the IN-L 306-2 can be applied to the driver circuit 302-2. On the other hand, the driver circuit 302-3 can be fed with a reference signal 310, for example a common mode signal. Further, in said embodiment, the system 300 includes the calibration unit 202 (not shown in this figure) coupled to the pin interfaces 304 in a similar manner as coupled to the pin interfaces 104 in the description of FIG. 2. The system 300 also includes a pre-biasing circuit 312 and speakers 314-1 and 314-2, collectively referred to as speakers 314. The speaker 314-1 can be coupled to the pin interfaces 304-1 and 304-3, while the speaker 314-2 can be coupled to the pin interfaces 304-2 and 304-3.

In operation, the input signal 306 can be generated from a variety of sources, such as an analog to digital (A2D) converter, and can be applied to the driver circuits 302-1 and 302-2 as signals IN-R 306-1 and the IN-L 306-2 respectively for stereo playback. Generally, the IN-R 306-1 and IN-L 306-2 can be applied to the driver circuits 302-1 and 302-2 either through a mono signal pathway or a stereo signal pathway. The mono signal pathway refers to a single conducting path and the stereo signal pathway refers to separate conducting paths coupled to a single source, such as A2D converter, providing a signal, for example, the input signal 306.

When the IN-R 306-1 and IN-L 306-2 are applied to the respective driver circuits 302-1 and 302-2 through the stereo signal pathway, any erroneous differential voltage appearing across the speakers 312 coupled to the pin interfaces 304 can cause an unwanted pop-up noise to emanate from the speaker 312-1. However, to avoid such unwanted pop-up noise from the speakers 312, correction signals can be provided with the signals IN-R 306-1 and IN-L 306-2 20 independently due to the separate signal pathways. However, application of the IN-R 306-1 and the IN-L 306-2 through the mono signal pathway causes a pop-up noise as the signals can not be independently corrected.

Typically, in devices such as a low-end mobile phone with limited functionality, the IN-R 306-1 and IN-L 306-2 are applied to the respective driver circuits 302-1 and 302-2 through a mono signal pathway rather than a stereo signal pathway. Though the signals 306-1 and 306-2 originated from a single input signal 306 and share the mono signal pathway, the corresponding output signals can have different DC offsets at respective pin interfaces 304-1 and 304-2. However, correction can be made for a particular DC offset even when the output signals suffer from different DC offsets. As a result, only one output signal between the output signals provided by the driver circuits 302-1 and 302-2 can be corrected for an underlying direct current (DC) offset at a given time. In other words, the mono signal pathways of the input signals 306-1 and 306-2 lead to mono correction of the output signals received from the respective driver circuits 302-1 and 302-2. Due to this, a pop-up noise can be produced from one of the speakers, such as speaker 312-1, for which correction has not been made.

In order to suppress the pop-up noise during power-up, the prebiasing circuit 312 provides the correction signal 316-1 to the driver circuit 302-1 and the correction signal 316-2 to the driver circuit 302-2. The correction signals 316-1 and 316-2 adjust the output signals of the driver circuits 302-1 and 302-2 to minimize the DC offset in the corresponding output signals.

For this, in an implementation, the pre-biasing circuit 312 determines DC offsets in the output signals of the driver circuits 302-1 and 302-2 at the respective pin interfaces 304-1 and 304-2. For example, the pre-biasing circuit 312 may obtain the DC offsets from the calibration unit 202. The pre-biasing circuit 312 provides a correction signal to first adjust one of the output signals. In one implementation, the pre-biasing circuit 312 may first adjust the output signal having a greater DC offset. For example, in case the DC offset in the output signal received at the pin interface 304-1 is greater than that in the output signal received at the pin interface 304-2, the pre-biasing circuit 312 first adjusts the output signal received at the pin interface 304-1 by applying the correction signal 316-1 to the driver circuit 302-1 while the driver circuit 302-1 is being powered up.

Subsequently, the pre-biasing circuit 312 ramps, or linearly changes, the correction signal 316-1 to provide a second correction signal such as the correction signal 316-2. The correction signal 316-2 is then applied to the driver circuit 302-2 to adjust its output signal while the driver circuit 302-2 is being powered up. In an implementation, when the DC offset in the output signal of the driver circuit 302-2 is less than the DC offset in the output signal of the driver circuit 302-1, the pre-biasing circuit 312 ramps down the correction signal 316-1 to obtain the correction signal 316-2.

In one implementation, the correction signals 316-1 and 316-2 can be produced based on the calibration data provided by a calibration unit such as the calibration unit 202. The calibration data includes a measurement of the DC offset depending on a difference between the received output signal and the expected output signal at the pin interfaces 304-1 and 304-2. Accordingly, the output signals of the driver circuits 302-1 and 302-2 received at the pin interfaces 304-1 and 304-2 can be adjusted to provide the expected output signals.

It will be understood that the exemplary circuits 100, 200 and 300 can be implemented simultaneously to minimize or completely suppress the popnoise in speakers. Further, it will be understood that the control unit 120 and the calibration unit 202 may be combined into a single unit or may be separate units.

In operation, the calibration may be performed when a system, such as a mobile phone, a laptop or a PDA, is powered on. For calibration, when a user powers on the system, the calibration unit 202 can determine the DC offset-signal at the various pin interfaces. As discussed, when two or more pin interfaces share a driver circuit, then the calibration unit 202 calibrates the driver circuit at one of the pin interfaces and re-uses the calibration data for calibrating the driver circuit at complimentary pin interfaces coupled to the same driver circuit. Thus the time required for calibration is substantially reduced. This calibration data is stored by the calibration unit for future reference.

Further, when the system receives a signal to power on a set of pin interfaces coupled to shared driver circuits, for example, to provide input signals to the speakers 314, the control unit 120 first powers up complementary pin interfaces. While powering up the complimentary pin interfaces, the pre-biasing circuit 312 determines the DC offset at the complimentary pin interfaces from the stored calibration data. The pre-biasing circuit 312 first provides a required DC offset correction signal to a first driver circuit till the first driver circuit is powered up. The pre-biasing circuit 312 then ramps the correction signal to correct for DC offset in an output signal of a second driver circuit. The ramped correction signal is provided to the second driver circuit till the second driver circuit is powered up. Thus DC offset correction can be performed for two driver circuits even when the two driver circuits share a mono signal pathway.

Once the voltages at the complementary pin interfaces coupled to the first and second driver circuits reach a desired value, the control unit 120 switches the power output to the set of pin interfaces. Thus pop-up noise due to transient mismatches during power up of the shared driver circuits can be avoided.

Although embodiments for suppression of pop-up noise in audio have been described in language specific to structural features and/or methods, it is to be understood that the invention is not necessarily limited to the specific features or methods described. Rather, the specific features and methods are disclosed as exemplary implementations for the suppression of pop-up noise in audio.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A system comprising:

a first driver circuit having a first driver output;

a first pin interface coupled to the first driver output via a first switch;

a second pin interface coupled to the first driver output via a second switch;

a control unit coupled to the first switch and second switch, wherein the control unit is configured to activate the first pin interface by:

switching the second switch to provide an output from the first driver circuit to the second pin interface while the first driver circuit is powering up; and switching the first switch to provide the output of the first driver circuit to the first pin interface when the first driver output reaches a threshold voltage; and a calibration unit configured to calibrate the first driver circuit at the first pin interface and obtain calibration data.

2. The system as claimed in claim 1, wherein the calibration data includes a measure of an offset at the first pin interface.

3. The system of claim 1, wherein the calibration unit is configured to use the calibration data corresponding to the first pin interface for calibrating the first driver circuit output switch to the second pin interface.

4. The system as claimed in claim 1, wherein the calibration unit is configured to calibrate the first driver circuit when the system is powered on.

5. The system as claimed in claim 1, wherein the control unit and the calibration unit are integrated into a single unit.

6. The system as claimed in claim 1, wherein the system is a mobile phone.

7. The system as claimed in claim 1, further comprising:

a third pin interface; and a speaker coupled between the second pin interface and the third pin interface, the speaker being configured to be driven by the first driver after the output of the first driver reaches the threshold voltage.

8. A method comprising:

powering up a first driver circuit;

providing an output of the first driver circuit, during the powering up, to a first pin interface connected to the first driver circuit;

providing an offset correction signal to the first driver circuit during the powering up; and switching the output of the first driver circuit to a second pin interface when the driver circuit is powered up, wherein the second pin interface shares the first driver circuit output with the first pin interface.

9. The method as claimed in claim 8, further comprising:

collecting calibration data from the first pin interface; and determining a value, by a calibration unit, for the offset correction signal from calibration data of the first driver circuit.

10. The method as claimed in claim 8, further comprising powering up a second driver circuit, the second driver circuit having a second output connected to a speaker, the speaker also being connected to the first driver output via the second pin interface.

11. The method as claimed in claim 10, further comprising providing a ramped correction signal to the second driver circuit during the powering up of the second driver circuit.

12. The method as claimed in claim 11, wherein the ramped correction signal is obtained by ramping the offset correction signal.

* * * * *